US011517049B2

(12) United States Patent
Liu et al.

(10) Patent No.: US 11,517,049 B2
(45) Date of Patent: Dec. 6, 2022

(54) E-CIGARETTE AND CIRCUMFERENTIALLY HEATING TYPE CURING NEEDLE FOR THE SAME

(71) Applicant: SHENZHEN BUDDY TECHNOLOGY DEVELOPMENT CO., LTD, Guangdong (CN)

(72) Inventors: Xiang Liu, Guangdong (CN); Hui Li, Guangdong (CN)

(73) Assignee: SHENZHEN BUDDY TECHNOLOGY DEVELOPMENT CO., LTD, Guangdong (CN)

( * ) Notice: Subject to any disclaimer, the term of this patent is extended or adjusted under 35 U.S.C. 154(b) by 538 days.

(21) Appl. No.: 16/618,405

(22) PCT Filed: Aug. 11, 2017

(86) PCT No.: PCT/CN2017/097082
§ 371 (c)(1),
(2) Date: Dec. 2, 2019

(87) PCT Pub. No.: WO2019/014991
PCT Pub. Date: Jan. 24, 2019

(65) Prior Publication Data

US 2020/0367562 A1 Nov. 26, 2020

(30) Foreign Application Priority Data

Jul. 20, 2017 (CN) ..... 201710596795.0

(51) Int. Cl.
*A24F 13/00* (2006.01)
*A24F 40/46* (2020.01)
(Continued)

(52) U.S. Cl.
CPC ..... *A24F 40/46* (2020.01); *H05B 1/0291* (2013.01); *H05B 3/06* (2013.01); *H05B 3/18* (2013.01); *A24F 40/20* (2020.01)

(58) Field of Classification Search
CPC ..... A24F 47/00
(Continued)

(56) References Cited

U.S. PATENT DOCUMENTS

2013/0152922 A1 6/2013 Benassayag et al.
2017/0042243 A1* 2/2017 Plojoux ..... A24F 40/50
2017/0055580 A1* 3/2017 Blandino ..... H05B 6/36

FOREIGN PATENT DOCUMENTS

CN 203748673 8/2014
CN 204377936 6/2015
(Continued)

OTHER PUBLICATIONS

"International Search Report (Form PCT/ISA/210) of PCT/CN2017/097082", dated Apr. 26, 2018, with English translation thereof, pp. 1-5.

*Primary Examiner* — Phuong K Dinh
(74) *Attorney, Agent, or Firm* — JCIPRNET

(57) ABSTRACT

A circumferentially heating type curing needle is adapted for an E-cigarette and comprises a curing needle head that is built-in with a heating element. The curing needle head is externally plated with a non-stick coating which is a polytetrafluoroethylene (PTFE) coating or a PTFE non-stick nano coating. The curing needle head is further provided with a fixed support and a ceramic base, the ceramic base is secured into the fixed support, and the curing needle head is fixedly inserted into the ceramic base. The E-cigarette is provided with the aforesaid circumferentially heating type curing needle.

14 Claims, 5 Drawing Sheets

(51) Int. Cl.

| | |
|---|---|
| ***H05B 1/02*** | (2006.01) |
| ***H05B 3/06*** | (2006.01) |
| ***H05B 3/18*** | (2006.01) |
| *A24F 40/20* | (2020.01) |

(58) Field of Classification Search
USPC ..... 131/328–329
See application file for complete search history.

(56) References Cited

FOREIGN PATENT DOCUMENTS

| | | |
|---|---|---|
| CN | 204653785 | 9/2015 |
| CN | 204837995 | 12/2015 |
| CN | 106912986 | 7/2017 |
| CN | 207220158 | 4/2018 |

* cited by examiner

E-CIGARETTE AND CIRCUMFERENTIALLY HEATING TYPE CURING NEEDLE FOR THE SAME

CROSS-REFERENCE TO RELATED APPLICATION

This application is a 371 of international application of PCT application serial no. PCT/CN2017/097082, filed on Aug. 11, 2017, which claims the priority benefit of China application no. 201710596795.0, filed on Jul. 20, 2017. The entirety of each of the above mentioned patent applications is hereby incorporated by reference herein and made a part of this specification.

BACKGROUND

Technical Field

The present invention relates to curing and heating equipment for an E-cigarette, in particular to an E-cigarette and a circumferentially heating type curing needle for the E-cigarette.

Description of Related Art

A flue-cured E-cigarette is a novel E-cigarette for heating an atomizing medium such as tobacco to produce smoke through a curing and heating element. However, on account that the curing and heating element is directly in contact with the atomizing medium such as tobacco in actual use, the atomizing medium such as tobacco and curing residues thereof will be adhered to the curing and heating element in curing and heating, so as to produce carbon deposits easily in repeated curing and to cause insufficiently pure curing taste. Moreover, a part of atomizing medium such as tobacco and curing residues thereof will be in a high temperature curing state for a long time to produce hazardous substances such as tar and nicotine, which is harmful to the human health.

SUMMARY

The technical problem to be solved by the present invention is to provide an E-cigarette and a circumferentially heating type curing needle for the E-cigarette with respect to the above problems of the prior art. The E-cigarette has the advantages of being uniform to cure and heat, simple and quick to install, and mellow in taste, and being capable of reducing tar and nicotine in the cigarette and smoking without carbon deposits in a healthy and energy-saving and environmental protection way.

To solve the above technical problem, the technical solution applied by the present invention is as follows.

The present invention provides a circumferentially heating type curing needle for an E-cigarette, comprising a curing needle head that is built-in with a heating element. The curing needle head is externally plated with a non-stick coating.

Preferably, the non-stick coating is a polytetrafluoroethylene (PTFE) non-stick coating.

Preferably, the non-stick coating is a PTFE non-stick nano coating.

Preferably, the curing needle head is further provided with a fixed support and a ceramic base. The said ceramic base is secured into the fixed support, and the curing needle head is fixedly inserted into the ceramic base.

Preferably, the fixed support is made of PEEK plastic cement.

Preferably, the curing needle head comprises an outer metal tube and a ceramic tube, the outer metal tube is fixedly inserted into the ceramic base, and the ceramic tube is inserted into the outer metal tube, and a plurality of hollow tubes are arranged in the ceramic tube. The hollow tubes are respectively provided with thermocouples and thermal fuses served as the heating element, and the outer metal tube is externally plated with the non-stick coating.

Preferably, the fixed support is formed in a hollow cylindrical shape, and the ceramic base is formed in a tubular shape. The ceramic base is fixedly inserted into an inner hole at one end of the fixed support, and the outer metal tube is fixedly inserted into an inner hole of the ceramic base.

Preferably, the outer metal tube is made of a 304 stainless steel.

Preferably, the thermocouple is a K-type thermocouple.

Furthermore, the present invention further provides an E-cigarette, and the E-cigarette is internally provided with the aforesaid circumferentially heating type curing needle for the E-cigarette.

The circumferentially heating type curing needle for the E-cigarette provided by the present invention has the following advantages.

1. The circumferentially heating type curing needle for the E-cigarette provided by the present invention comprises the curing needle head that is built-in with the heating element; circumferentially heating can be realized through the curing needle head with the advantages of being uniform to cure and heat and being simple and quick to install.

2. The curing needle head of the circumferentially heating type curing needle for the E-cigarette provided by the present invention is externally plated with the non-stick coating. The non-stick coating can effectively prevent the atomizing medium such as tobaccos and the curing residues thereof from being adhered to the curing and heating element in curing and heating, so as to avoid carbon deposits, tar, nicotine and other harmful substances easily generated in repeatedly curing. The E-cigarette is advantageous in being mellow in taste, being capable of decreasing tar and nicotine in the cigarette, and smoking without carbon deposits in a healthy and energy-saving and environmental protection way.

The E-cigarette provided by the present invention comprises the circumferentially heating type curing needle for the E-cigarette, and also has the aforesaid advantages of the circumferentially heating type curing needle for the E-cigarette, so it will not be discussed here.

DESCRIPTION OF THE EMBODIMENTS

First Embodiment

Figure 1:
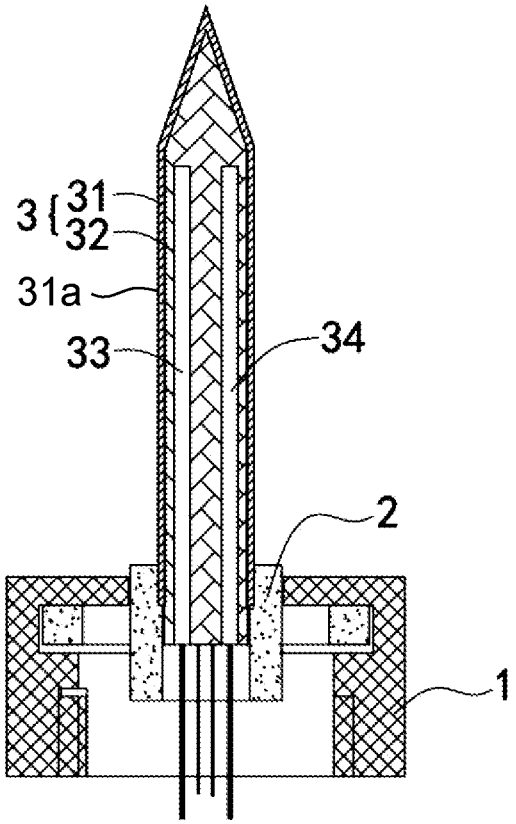
FIG. 1 is a structural section view of an embodiment of the present invention.
Figure 2:
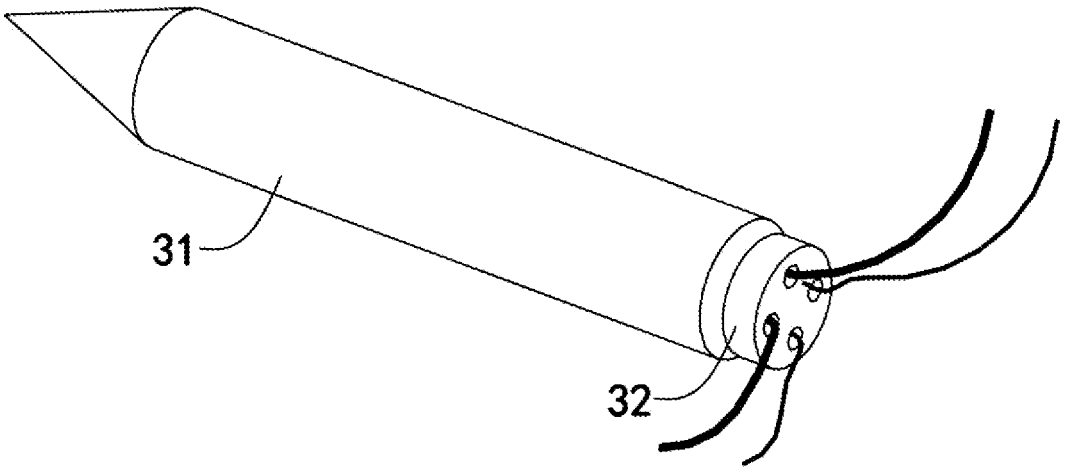
FIG. 2 is a three-dimensional view of a curing needle head in an embodiment of the present invention.

As shown in FIG. 1 and FIG. 2, a circumferentially heating type curing needle of the embodiment is adapted for an E-cigarette. The curing needle comprising a curing needle head 3 that is built-in with a heating element, wherein the curing needle head 3 is externally plated with a non-stick coating 31*a*. The circumferentially heating type curing needle for the E-cigarette in this embodiment is used for circumferentially heating by the curing needle head 3 with the advantages of being simple and quick to install and uniform to cure and heat. The curing needle head 3 that is externally plated with the non-stick coating 31*a* can effectively prevent the atomizing medium such as tobaccos and the curing residues thereof from being adhered to the curing and heating element in curing and heating, so as to avoid carbon deposits, tar, nicotine and other harmful substances easily generated in repeatedly curing. The E-cigarette is advantageous in being mellow in taste, and being capable of decreasing tar and nicotine in the cigarette, and smoking without carbon deposits in a healthy and energy-saving and environmental protection way.

A polytetrafluoroethylene (PTFE) non-stick coating is particularly applied in this embodiment. Undoubtedly, this embodiment features in that the curing needle head 3 is externally plated with the non-stick coating 31*a* for the non-stick feature outside the curing needle head 3. Hence, under the above technical revelation, those skilled in the art can unambiguously determine that the non-stick coating 31*a* of this embodiment is not limited to specific materials. Any materials which can be cured against high temperature without harmful substances can be considered for the non-stick coating 31*a*.

As shown in FIG. 1 and FIG. 2, the curing needle head 3 is further provided with a fixed support 1 and a ceramic base 2. The ceramic base 2 is secured into the fixed support 1, and the curing needle head 3 is fixedly inserted into the ceramic base 2. The curing needle head 3 is integrally installed by the fixed support 1 and the ceramic base 2, so that the curing needle head 3 can be installed more conveniently. Moreover, the fixed support 1 and the ceramic base 2 can be insulated doubly to prevent heat from being transferred to the outside of the E-cigarette, improve heating efficiency and prevent the E-cigarette from scalding the hand.

In this embodiment, the fixed support 1 is made of PEEK plastic cement with the advantages of good insulation performance, thereby further improving heating efficiency and preventing the E-cigarette from scalding the hand.

As shown in FIG. 1 and FIG. 2, the curing needle head 3 comprises an outer metal tube 31 and a ceramic tube 32. The outer metal tube 31 is fixedly inserted into the ceramic base 2, and the ceramic tube 32 is inserted into the outer metal tube 31, and a plurality of hollow tubes are arranged in the ceramic tube 32. The hollow tubes are respectively provided with thermocouples 34 and thermal fuses 33 as the heating element, and the outer metal tube 31 is externally plated with the non-stick coating 31*a*.

Uniform external heat can be ensured for uniformly curing and heating by the outer metal tube 31 at the outside. The ceramic tube 32 is internally provided with a plurality of hollow tubes installed with thermocouples 34 and thermal fuses 33 as the heating element. On the one hand, installation of the thermal fuses 33 and the thermocouples 34 can be simplified; on the other hand, heating efficiency and temperature detection accuracy can be improved to prevent tar, nicotine and harmful substances caused by overheating curing due to inaccurate temperature detection.

In this embodiment, the fixed support 1 is formed in a hollow cylindrical shape, the ceramic base 2 is formed in a tubular shape, the ceramic base 2 is fixedly inserted into an inner hole at one end of the fixed support 1, and the outer metal tube 31 is fixedly inserted into an inner hole of the ceramic base 2. Through the above structure, the circumferentially heating type curing needle for the E-cigarette can be installed quickly by means of pluggable installation.

In this embodiment, the outer metal tube 31 is made of a 304 stainless steel with the advantages of physiochemical performances and temperatures and environmental protection and health.

In this embodiment, the thermocouple 34 is a K-type thermocouple, especially applicable to hollow tube structure installation.

It should be noted that the circumferentially heating type curing needle for the E-cigarette in this embodiment can be sold separately or completely, or as an integrated part of the E-cigarette. For example, the curing needle is sold in such a manner of integrating into the circumferentially heating type curing needle for the E-cigarette.

Figure 3:
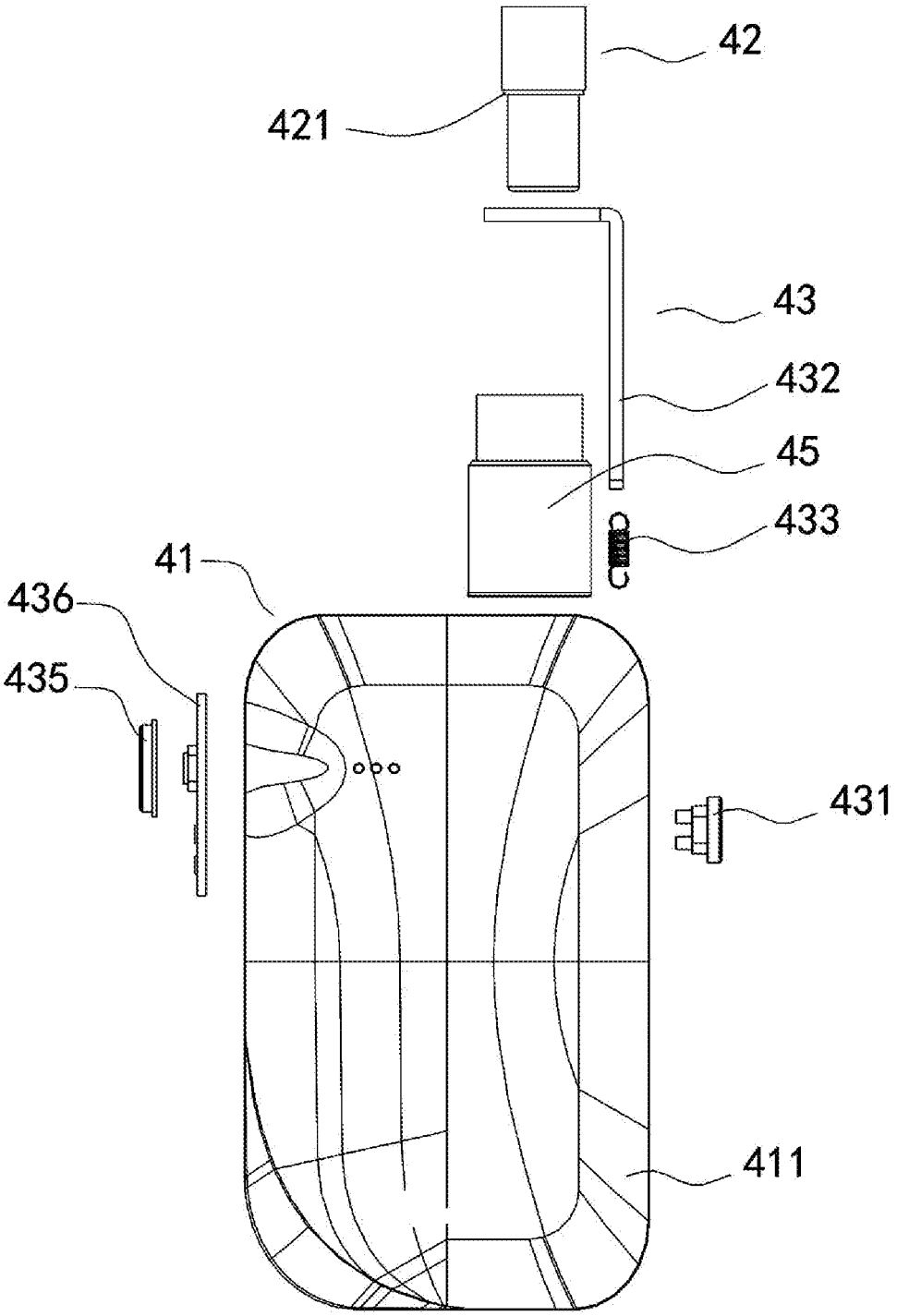
FIG. 3 is a main exploded structure of an E-cigarette in a first embodiment of the present invention.
Figure 4:
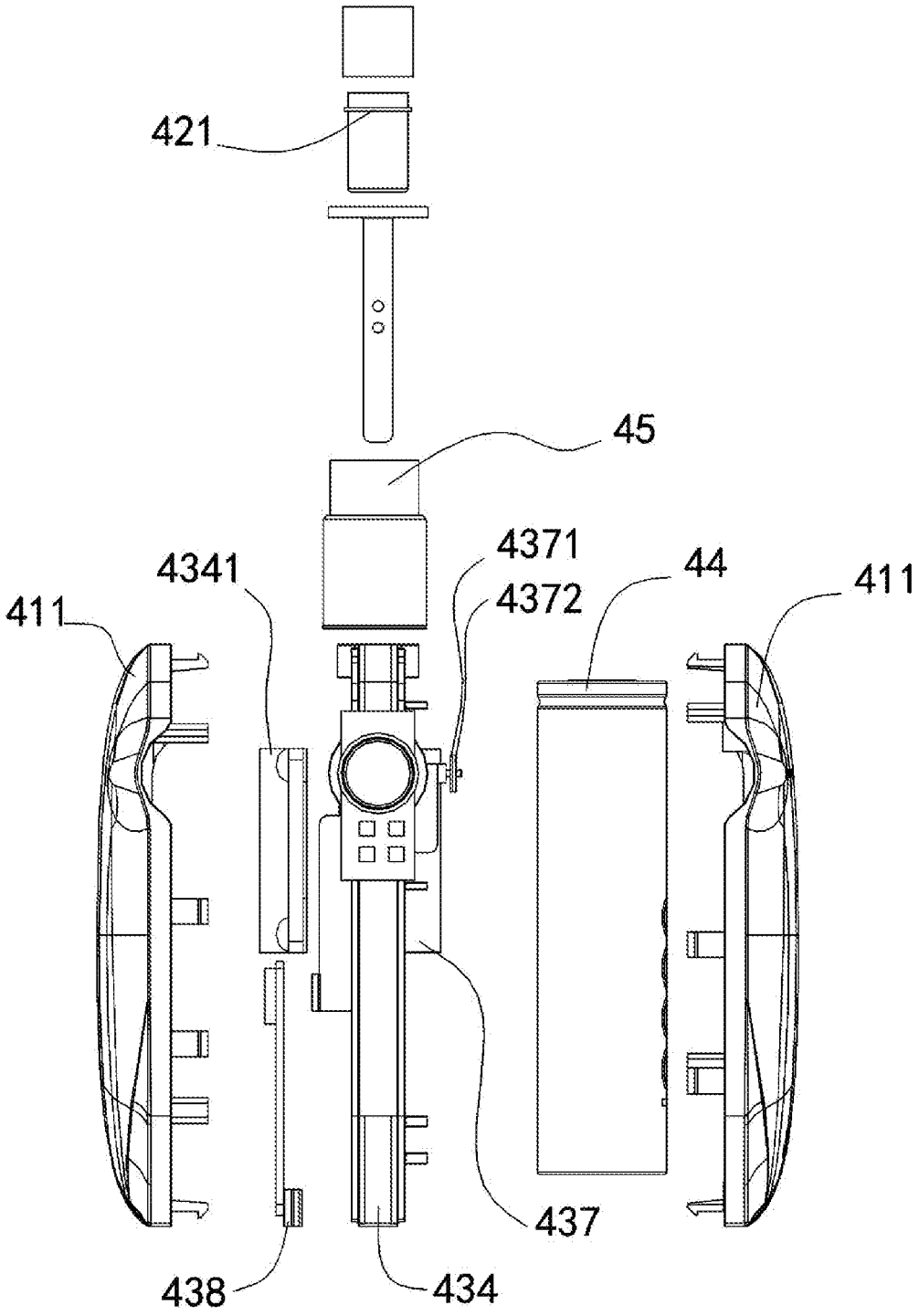
FIG. 4 is a side exploded structure of the E-cigarette in the first embodiment of the present invention.

As shown in FIG. 3 and FIG. 4, the E-cigarette applied to the circumferentially heating type curing needle for the E-cigarette in this embodiment comprises an E-cigarette body 41. A cartridge 42 connected in a plugging way is provided on the E-cigarette body 41, and one side of the E-cigarette body 41 is provided with a chute. A cartridge assembly 43 is provided in the chute. A cartridge pushing assembly 43 comprises a slider button 431 and a sliding support 432. The slider button 431 is disposed in the chute in a sliding manner and is disposed outside the E-cigarette body 41. The slider button 431 and the sliding support 432 are connected fixedly, and a top portion of the sliding support 432 is propped against a lower side of the cartridge 42. The cartridge 42 can be quickly pushed for replacement by the cartridge pushing assembly 43 by virtue of applying the replaceable cartridge 42, with the advantages of being convenient to replace, simple in structure and convenient to use.

As shown in FIG. 3 and FIG. 4, the top portion of the sliding support 432 is provided with an annular portion 4321, an outer wall of the cartridge 42 is provided with an annular stress flange 421, and the annular portion 4321 is sleeved outside the cartridge 42 and is located at the lower side of the annular stress flange 421. The cartridge 42 can be reliably pushed for replacement through the annular stress flange 421, and the annular portion 4321 and the annular stress flange 421 are of an annular structure to make sure uniform thrust, small resistance and uneasiness to clamp when the cartridge 42 is pushed.

As shown in FIG. 3 and FIG. 4, the cartridge pushing assembly 43 further comprises a spring 433, one end of the sliding support 432 is provided with an annular part 4321, and the other end thereof is connected with an inner structure of the E-cigarette body 41 through the spring 433. The sliding support 432 can be restored automatically through the spring 433, so that the cartridge 42 can be restored to the original state after pushed every time (the cartridge 42 is inserted for installation). Hence, it is convenient to operate.

As shown in FIG. 3 and FIG. 4, a mounting support 434 is provided between the slider button 431 and the sliding support 432, and the slider button 431 is connected with the sliding support 432 through the mounting support 434. In this embodiment, the E-cigarette body 41 comprises a case 411 and a battery 44 arranged in the case 411, a control module and a heating needle assembly 45 with a heating needle. The heating needle of the heating needle assembly 45 is inserted into an insertion hole at a bottom portion of the cartridge 42, and the battery 44 and the heating needle of the heating needle assembly 45 are electrically connected with the control module. The cartridge 42 consists of a mouthpiece and a cigarette cup, both of which are connected with each other. The cigarette cup is internally provided with cut tobaccos and a bottom portion of the cigarette cup is provided with an insertion hole, and the heating needle of the heating needle assembly 45 can cure the cut tobaccos in the cigarette cup, so that smoke can be sucked from the mouthpiece of the cartridge 42.

As shown in FIG. 4, the case 411 is provided with a main key comprising a key cap 435 and a key circuit board 436. The key circuit board 436 is welded with an FPC assembly 437 with a light source. A shade piece 4371 and a light pipe 4372 are respectively arranged between the outside of the FPC assembly 437 and the E-cigarette body 41 and the key circuit board 436 is connected with the control module. The key circuit board 436 of the main key is welded with the FPC assembly 437 with the light source; the FPC assembly 437 is a flexible circuit which is good in applicability and saves more space; and moreover, the operating status of the E-cigarette can be known by the shade piece 4371 and the light pipe 4372 conveniently.

As shown in FIG. 4, the heating needle assembly 45 is secured onto the mounting support 434, and a fixing cover 4341 is further connected between the heating needle assembly 45 and the mounting support 434. In this embodiment, the control module is specifically provided in the heating needle assembly 45, and the fixing cover 4341 is fixedly connected with the heating needle assembly 45 and the mounting support 434 through tapping screws, respectively.

As shown in FIG. 4, the case 411 is internally provided with a USB charging interface 438 connected with the control module for charging the battery 44. In this embodiment, a 18650 pouch battery is applied as the battery 44.

Second Embodiment

In this embodiment, the non-stick coating is a PTFE non-stick nano coating. With respect to an ordinary PTFE non-stick coating, the PTFE non-stick nano coating has the advantages of more smooth surface, strong adhesion and more advanced process, and can further strengthen the performance of preventing the atomizing medium such as tobaccos and the curing residues thereof from being adhered to the curing and heating element in curing and heating, and enhancing the efficiency of avoiding carbon deposits, tar, nicotine and other harmful substances easily generated in repeatedly curing. The E-cigarette is mellower in taste, and better in effect of decreasing tar and nicotine in the cigarette.

Figure 5:
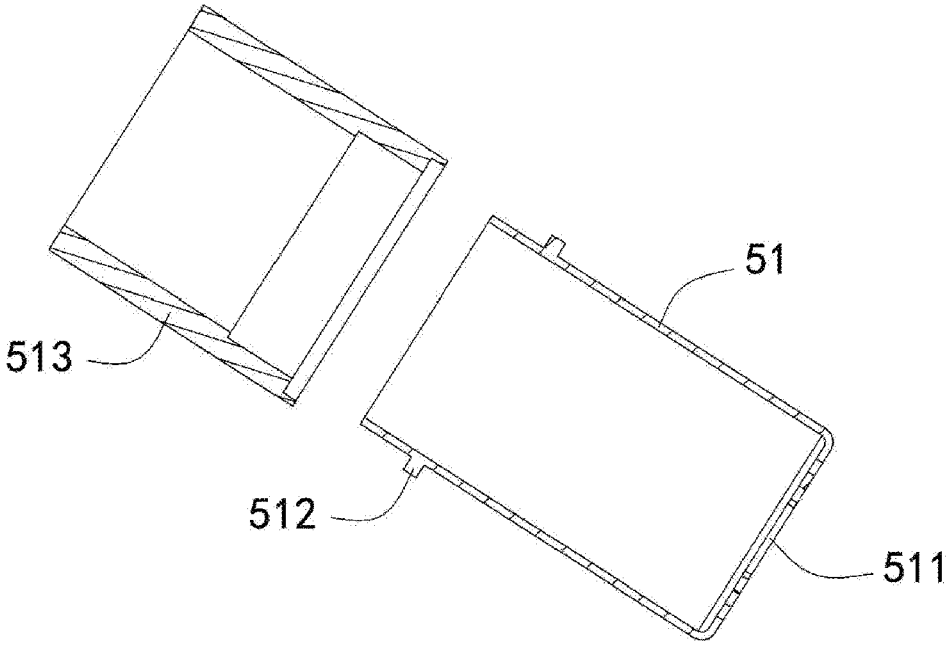
FIG. 5 is a sectional exploded structure of a cartridge in a second embodiment of the present invention.

As shown in FIG. 5, the cartridge of this embodiment comprises a cigarette cup 51 filled with the cut tobaccos, and a bottom portion of the cigarette cup 51 is provided with an insertion hole 511 for inserting the heating needle. Through the above structure, the tobaccos can be circumferentially cured in a heating way by inserting the heating needle into the bottom portion, thereby effectively solving the technical problems that the curing effect is poor and the amount of atomized smoke is low in case of many tobaccos, and realizing efficient curing, high curing efficiency, high amount of smoke and convenience and rapidness to clear up and replace. The bottom portion of the cigarette cup 51 is provided with the insertion hole 511 for inserting the heating needle to support circumferentially heating type curing with the advantages of being simple and quick to install, and mellow in taste, uniform to cure and heat, and being capable of decreasing tar and nicotine in the cigarette, and smoking without carbon deposits in a healthy and energy-saving and environmental protection way. As shown in FIG. 5, an outer wall of the cigarette cup 51 is provided with the stress projection 512 of the cigarette cup 51, and the stress projection 512 is used for pushing the cigarette cup 51 to push out the cartridge in a labor-saving and reliable way. As shown in FIG. 5, an opening end of the cigarette cup 51 is further sleeved with a mouthpiece 513, so that the mouthpiece 513 is replaced when the cartridge is replaced, leading to better hygiene and reliability.

Figure 6:
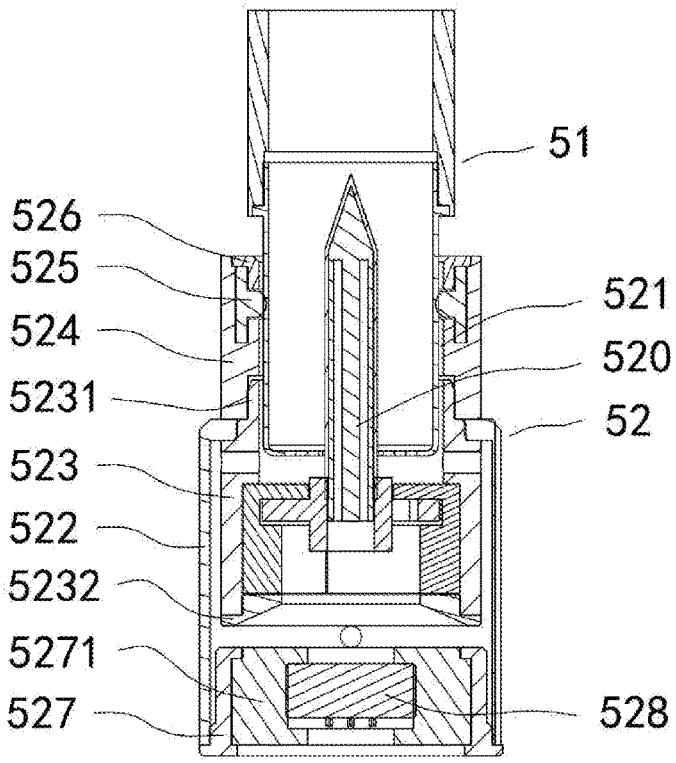
FIG. 6 is a structural section view of a cartridge pushing type curing and heating assembly (including a cartridge) in the second Embodiment of the present invention.
Figure 7:
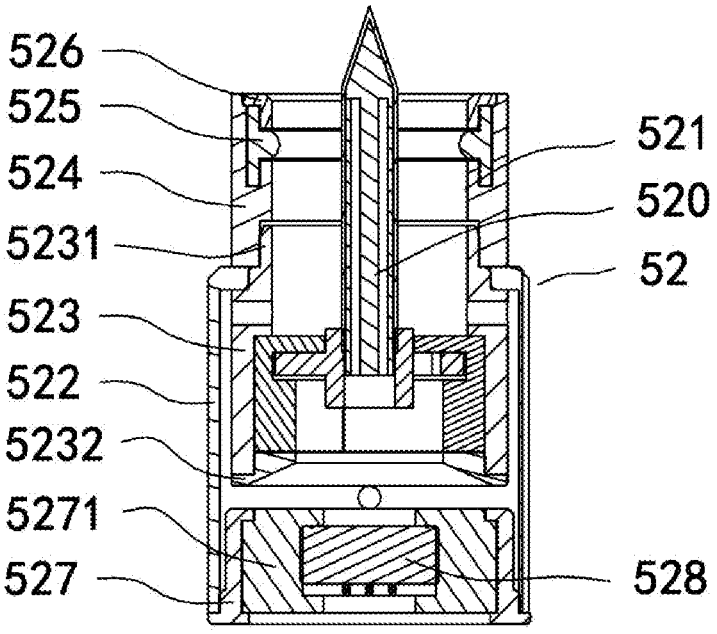
FIG. 7 is a structural section view of a cartridge pushing type curing and heating assembly (excluding the cartridge) in the second embodiment of the present invention.

As shown in FIG. 6 and FIG. 7, the cartridge pushing curing and heating assembly of this embodiment comprises a curing and heating needle assembly body 52 with a heating needle assembly 520, one end of the curing and heating needle assembly body 52 is provided with a cartridge insertion hole location 521, a root of the heating needle of the heating needle assembly 520 is secured at a bottom portion of the cartridge insertion hole location 521 in which the cartridge is inserted, and the heating needle of the heating needle assembly 520 is inserted into the insertion hole 511. The cartridge can be pushed by the above structure to solve the technical problems that the curing effect is poor and the amount of atomized smoke is low in case of many tobaccos. Meanwhile, the tobaccos can be circumferentially cured in a heating way by inserting the heating needle into the bottom, thereby effectively solving the technical problems that the curing effect is poor and the amount of atomized smoke is low in case of many tobaccos, and realizing efficient curing, high curing efficiency, high amount of smoke and convenience and rapidness to clear up and replace. The circumferentially heating type curing is supported, and the E-cigarette has the advantages of being uniform to cure and heat, simple and quick to install, and mellow in taste, and being capable of reducing tar and nicotine in the cigarette, and smoking without carbon deposits in a healthy and energy-saving and environmental protection way.

As shown in FIG. 6 and FIG. 7, the curing and heating assembly body 52 comprises an outer annular tube 522 and a connection ring 523 inserted into the outer annular tube 522. The heating needle assembly 520 is secured onto the connection ring 523, and one end of the connection ring 523 is provided with a connection plug 5231. The connection plug 5231 is connected with a seal tube 524 in an insertion way, the cartridge insertion hole location 521 is defined in an inner cavity of the seal tube 524, and the heating needle of the heating needle assembly 520 is inserted into the seal tube 524.

As shown in FIG. 6 and FIG. 7, a seal ring 525 and a pressing ring 526 are provided on an inner wall of an opening end of the seal tube 524, the pressing ring 526 is disposed outside the seal ring 525 to secure the seal ring 525 onto an inner wall of the seal tube 524, and an outer wall of the cigarette cup 51 of the cartridge is in interference fit with the seal ring 525. The cigarette cup 51 of the cartridge and the inner wall of the seal tube 524 are reliably sealed through the structure of the seal ring 525 and the pressing ring 526. Referring to FIG. 6, it can be seen that the seal ring 525 in this embodiment is of a tubular structure, and an inner wall of the tubular structure of the seal ring 525 is provided with a flange which protrudes and is disposed on the inner wall of the seal tube 524 so as to make sure reliable seal between the cigarette cup 51 of the cartridge and the inner wall of the seal tube 524.

As shown in FIG. 6 and FIG. 7, another end of the connection ring 523 is provided with a rear cover 5232 to prevent external sundries from entering the interior through the connection ring 523, and to effectively protect devices in the E-cigarette, thereby realizing higher safety and reliability. In this embodiment, the connection ring 523 is inserted into one inner cavity at one end of the outer annular tube 522, and the fixed support 527 is inserted into an inner cavity in another end of the outer annular tube 522, the fixed support 527 is provided with the control module 528 and the heating needle assembly 520 is electrically connected with the control module 528. In this embodiment, the fixed support 527 is provided with a flexible fixing sleeve 5271, and the control module 528 is disposed in the flexible fixing sleeve 5271. The flexible fixing sleeve 5271 in this embodiment is specifically made of silica gel, thereby being capable of effectively buffering the influence of external shock on the control module 528 to strengthen reliability of the control module 528 and to prolong the service life of the control module 528.

The above are only preferred embodiments of the present invention, and the protection scope of the present invention is not limited to the embodiment mentioned above. The technical solutions under the ideas of the present invention fall into the protection scope of the present invention. It should be pointed out that, for an ordinary person skilled in the art, some improvements and modifications without departing from the principle of the present invention shall be deemed as the protection scope of the present invention.

What is claimed is:

1. A circumferentially heating type curing needle adapted for an E-cigarette, the circumferentially heating type curing needle comprising a curing needle head that is built-in with a heating element, wherein the curing needle head is further provided with a fixed support and a ceramic base, the ceramic base is secured into the fixed support, and the curing needle head is fixedly inserted into the ceramic base, and the curing needle head comprises an outer metal tube and a ceramic tube, the outer metal tube is fixedly inserted into the ceramic base, and the ceramic tube is inserted into the outer metal tube; a plurality of hollow tubes are arranged in the ceramic tube, the hollow tubes are respectively provided with thermocouples and thermal fuses served as the heating element, and the outer metal tube is externally plated with a non-stick coating.

2. The circumferentially heating type curing needle according as claimed in claim 1, wherein the non-stick coating is a polytetrafluoroethylene (PTFE) non-stick coating.

3. The circumferentially heating type curing needle as claimed in claim 1, wherein the non-stick coating is a polytetrafluoroethylene (PTFE) non-stick nano coating.

4. The circumferentially heating type curing needle as claimed in claim 1, wherein the fixed support is made of PEEK plastic cement.

5. The circumferentially heating type curing needle as claimed in claim 1, wherein the fixed support is formed in a hollow cylindrical shape, the ceramic base is formed in a tubular shape, the ceramic base is fixedly inserted into an inner hole at one end of the fixed support, and the outer metal tube is fixedly inserted into an inner hole of the ceramic base.

6. The circumferentially heating type curing needle as claimed in claim 1, wherein the outer metal tube is made of 304 stainless steel.

7. The circumferentially heating type curing needle as claimed in claim 1, wherein the thermocouple is a K-type thermocouple.

8. An E-cigarette, comprising the circumferentially heating type curing needle as claimed in claim 1.

9. An E-cigarette, comprising the circumferentially heating type curing needle as claimed in claim 2.

10. An E-cigarette, comprising the circumferentially heating type curing needle as claimed in claim 3.

11. An E-cigarette, comprising the circumferentially heating type curing needle as claimed in claim 4.

12. An E-cigarette, comprising the circumferentially heating type curing needle as claimed in claim 5.

13. An E-cigarette, comprising the circumferentially heating type curing needle as claimed in claim 6.

14. An E-cigarette, comprising the circumferentially heating type curing needle as claimed in claim 7.

* * * * *